US006860248B1

(12) United States Patent
Mene

(10) Patent No.: US 6,860,248 B1
(45) Date of Patent: Mar. 1, 2005

(54) PROGRAMMABLE VEHICLE STARTING DEVICE

(76) Inventor: Engjell Mene, 8596 Hampshire Dr., Sterling Heights, MI (US) 48313

( * ) Notice: Subject to any disclaimer, the term of this patent is extended or adjusted under 35 U.S.C. 154(b) by 203 days.

(21) Appl. No.: 10/286,725

(22) Filed: Nov. 1, 2002

(51) Int. Cl.[7] ..... F02N 11/08
(52) U.S. Cl. ..... 123/179.2; 290/37 R
(58) Field of Search ..... 123/179.1, 179.2, 123/179.3, 179.4; 290/37 R, 38 R, 38 C; 180/167

(56) References Cited

U.S. PATENT DOCUMENTS 2,975,296 A 3/1961 Dominguez-Rego
4,079,366 A * 3/1978 Wong ..... 340/309.4
4,131,304 A 12/1978 Wagner
4,236,594 A * 12/1980 Ramsperger ..... 180/167
4,296,334 A * 10/1981 Wong ..... 290/37 R
4,674,454 A 6/1987 Phairr
5,063,513 A 11/1991 Shank et al.
5,485,954 A 1/1996 Guy et al.
5,831,514 A * 11/1998 Hilpert et al. ..... 340/309.8
D404,718 S 1/1999 Overall
5,995,889 A 11/1999 Eisenhour
D453,148 S * 1/2002 Alexander et al. ..... D13/168
6,559,558 B2 * 5/2003 Quesnel et al. ..... 307/10.6

* cited by examiner

*Primary Examiner*—Henry C. Yuen
*Assistant Examiner*—Arnold Castro

(57) ABSTRACT

A programmable vehicle starting device for starting a vehicle when the user is not in the vehicle. The programmable vehicle starting device includes a housing being designed for being mounted in the vehicle. A processing assembly is positioned within the housing. The processing assembly is designed for operationally coupling to an ignition system of the vehicle whereby the processing assembly starts an engine of the vehicle upon reaching a pre-determined time. A plurality of buttons are positioned on an upper face of the housing. Each of the buttons is operationally coupled to the processing assembly whereby the buttons are for manipulating the pre-determined time when the buttons are engaged by a finger of the user. A display screen is positioned on the upper surface of the housing. The display screen is operationally coupled to the processing assembly whereby the display screen is for displaying the pre-determined time.

15 Claims, 2 Drawing Sheets

PROGRAMMABLE VEHICLE STARTING DEVICE

BACKGROUND OF THE INVENTION

1. Field of the Invention

The present invention relates to remote vehicle starters and more particularly pertains to a new programmable vehicle starting device for starting a vehicle when the user is not in the vehicle.

2. Description of the Prior Art

The use of remote vehicle starters is known in the prior art. U.S. Pat. No. 5,995,889 describes a system for starting a vehicle and control the interior temperature of the vehicle when the user is away from the vehicle. Another type of remote vehicle starter is U.S. Pat. No. 4,674,454 having a remote control unit for starting the vehicle and controlling the interior environmental controls from a remote location from the vehicle.

While these devices fulfill their respective, particular objectives and requirements, the need remains for a device that has certain improved features that allows for the user to be notified when the vehicle has been started or the vehicle has failed to start.

SUMMARY OF THE INVENTION

The present invention meets the needs presented above by providing a sound producing device operationally coupled to the remote receiver for producing sounds when the vehicle has been started and the vehicle has failed to start.

Still yet another object of the present invention is to provide a new programmable vehicle starting device that allows the user to program which times the vehicle is to be started.

To this end, the present invention generally comprises a housing being designed for being mounted in the vehicle. A processing assembly is positioned within the housing. The processing assembly is designed for operationally coupling to an ignition system of the vehicle whereby the processing assembly starts an engine of the vehicle upon reaching a pre-determined time. A plurality of buttons are positioned on an upper face of the housing. Each of the buttons is operationally coupled to the processing assembly whereby the buttons are for manipulating the pre-determined time when the buttons are engaged by a finger of the user. A display screen is positioned on the upper surface of the housing. The display screen is operationally coupled to the processing assembly whereby the display screen is for displaying the pre-determined time.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
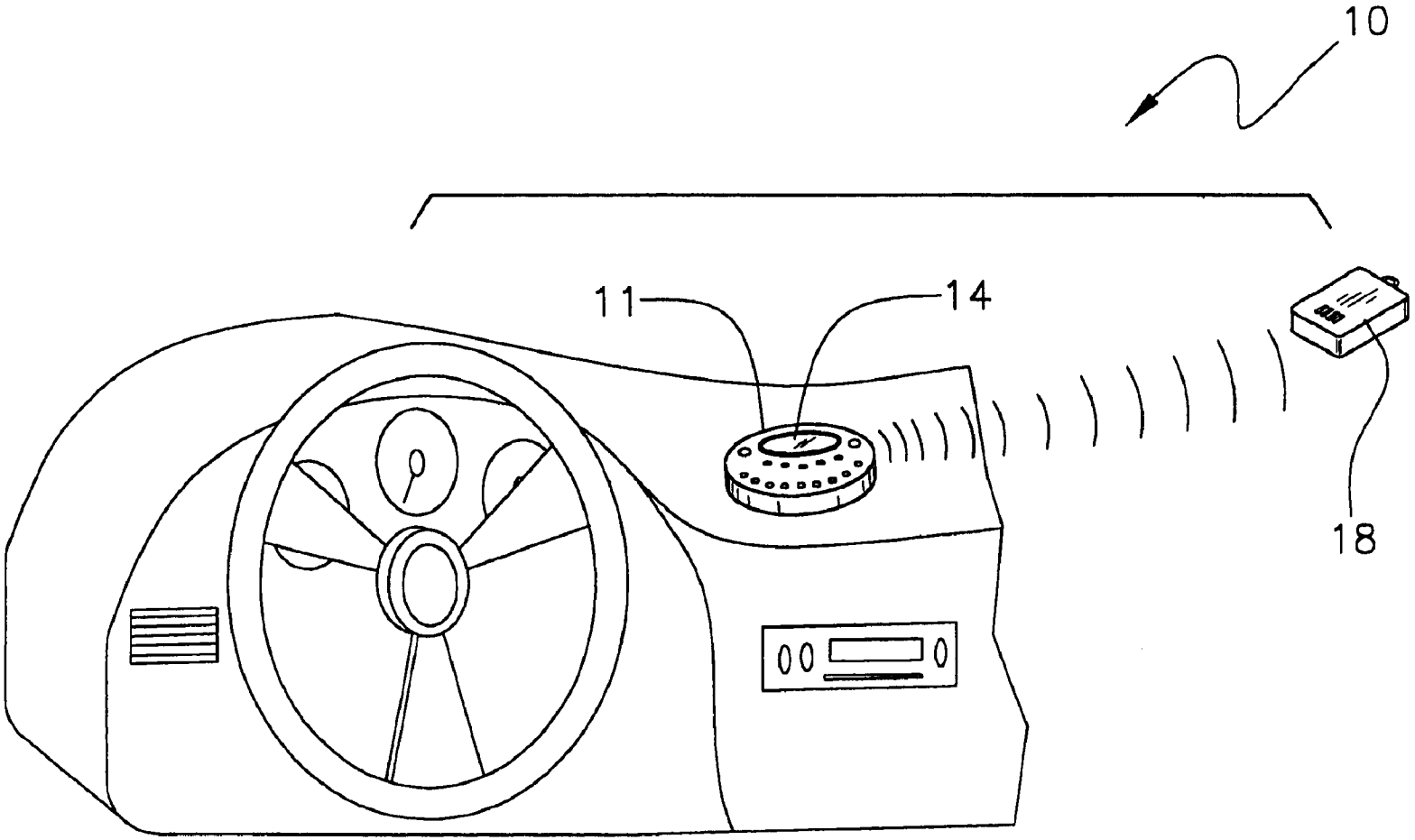
FIG. 1 is a perspective view of a new programmable vehicle starting device according to the present invention shown in use.
Figure 2:
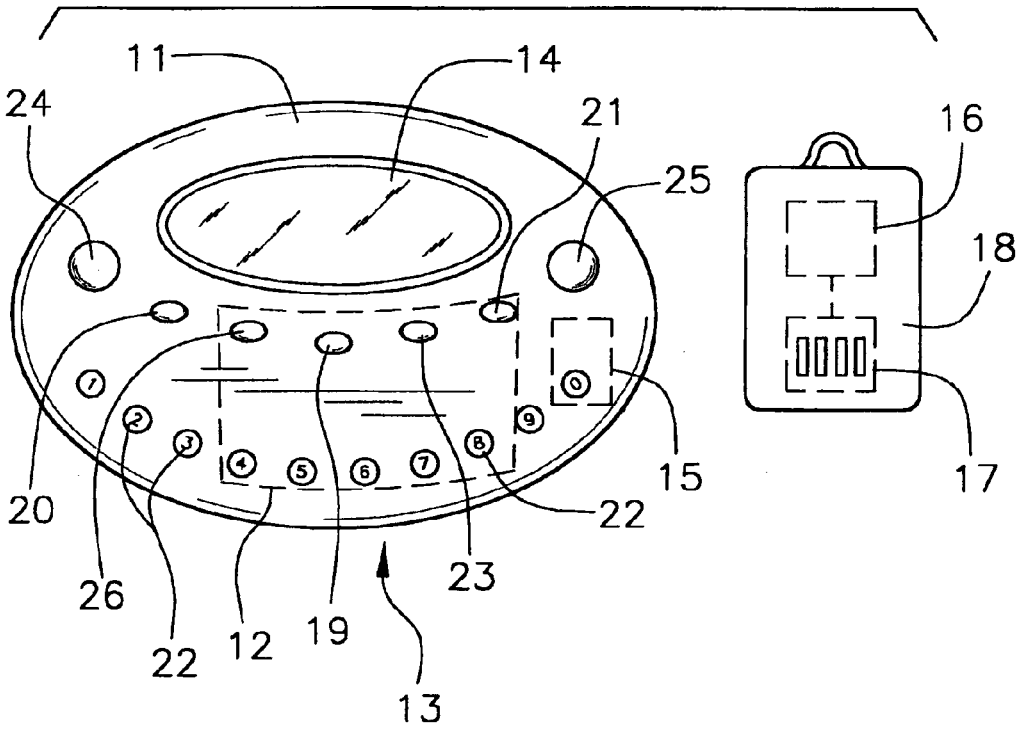
FIG. 2 is a top view of the present invention.

With reference now to the drawings, and in particular to FIGS. 1 and 2 thereof, a new programmable vehicle starting device embodying the principles and concepts of the present invention and generally designated by the reference numeral 10 will be described.

As best illustrated in FIGS. 1 and 2, the programmable vehicle starting device 10 generally comprises a housing 11 being designed for being mounted in the vehicle. A processing assembly 12 is positioned within the housing 11. The processing assembly 12 is designed for operationally coupling to an ignition system of the vehicle whereby the processing assembly 12 starts an engine of the vehicle upon reaching a pre-determined time. A plurality of buttons 13 are positioned on an upper face of the housing 11. Each of the buttons 13 is operationally coupled to the processing assembly 12 whereby the buttons 13 are for manipulating the pre-determined time when the buttons 13 are engaged by a finger of the user. A display screen 14 is positioned on the upper surface of the housing 11. The display screen 14 is operationally coupled to the processing assembly 12 whereby the display screen 14 is for displaying the pre-determined time.

A transmitter assembly 15 is operationally coupled to the processing assembly 12. The transmitter assembly 15 transmits a first signal to a remote receiver 16 when the processing assembly 12 starts the vehicle. The transmitter assembly 15 transmits a second signal to the remote receiver 16 when the vehicle has failed to start.

A sound producing device 17 is operationally coupled to the remote receiver 16. The sound producing device 17 is positioned within a remote housing 18. The sound producing device 17 produces a first unique sound designed for indicating the processing assembly 12 has started the vehicle when the remote receiver 16 has received the first signal. The sound producing device 17 producing a second unique sound designed for indicating the processing assembly 12 has failed to start the vehicle when the remote receiver 16 has received the second signal.

The buttons 13 comprise a start time button 19. The time button actuates the processor assembly for switching between a first start time and a second start time whereby the processing assembly 12 displays the first start time and the second start time on the display screen 14.

The buttons 13 comprises a clock button 20. The clock button 20 actuates the processor assembly for displaying a current time on the display screen 14.

The buttons 13 comprise a set button 21. The set button 21 actuates the processing assembly 12 for setting the first start time and the second start time for the processing assembly 12 to start the vehicle when the set button 21 is engaged after the start time button 19 has been depressed by the user. The set button 21 actuates the processing assembly 12 for setting the current time for the processing assembly 12 when the set button 21 is engaged after the clock button 20 has been depressed.

The buttons 13 comprise a plurality of time manipulation buttons 22 13. Each of the time manipulation buttons 22 13 actuates the processing assembly 12 for adjusting the first start time and the second start time the processing assembly 12 starts the vehicle when the time manipulation buttons 22 13 are engaged by the user. Each of the time manipulation buttons 22 13 actuates the processing assembly 12 for adjusting the current time displayed when the time manipulation buttons 22 13 are engaged by the user.

The buttons 13 comprise a meridiem selection button 23. The meridiem selection button 23 actuates the processing assembly 12 for adjusting the morning period and afternoon period of the first start time and the second start time. The meridiem selection button 23 actuates the processing assembly 12 for adjusting the morning period and afternoon period of the current time of the processing assembly 12.

The buttons 13 comprise an enter button 24. The enter button 24 is designed for indicating to the processor assembly the user has finished setting the first start time and the second start time. The enter button 24 is designed for indicating to the processor assembly the user has finished setting the current time.

The buttons 13 comprise a main button 25. The main button 25 is operationally coupled to the processing assembly 12. The main button 25 is designed for selectively disengaging the processing assembly 12 from the ignition system of the vehicle when the main button 25 is depressed by the user. The main button 25 is designed for selectively disconnecting the processing assembly 12 from a power supply of the vehicle when the main button 25 is held in depressed state for a length of time.

The buttons 13 comprise an alarm button 26. The alarm button 26 is operationally coupled to the processing assembly 12 whereby the alarm button 26 selectively disengages the processing assembly 12 from the transmitter for preventing signals being transmitted to the remote receiver 16 when the alarm button 26 is depressed by the user.

In use, the user sets the first start time when the user wants the vehicle to start and the second start time for the vehicle to starts. The current time is checked for accuracy and set if incorrect. The user then depresses the alarm button 26 to selectively choose whether signals are sent from the transmitter to the remote receiver 16 being carried by the user. The user then departs the vehicle. Upon the current time matching either the first start time or the second start time the processing assembly 12 starts the vehicle and sends the first signal to the remote receiver 16 to signal the vehicle has been started.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A programmable vehicle starting device for programming the starting of a vehicle for a user when the user is not in the vehicle, the programmable vehicle starting device comprising:

a housing being adapted for being mounted in the vehicle;

a processing assembly being positioned within said housing, said processing assembly being adapted for operationally coupling to an ignition system of the vehicle such that said processing assembly starts an engine of the vehicle upon reaching a pre-determined time;

a plurality of buttons being positioned on an upper face of said housing, each of said buttons being operationally coupled to said processing assembly such that said buttons are for manipulating the pre-determined time when said buttons are engaged by a finger of the user;

a display screen being positioned on said upper surface of said housing, said display screen being operationally coupled to said processing assembly such that said display screen is for displaying the pre-determined time; and a transmitter assembly being operationally coupled to said processing assembly, said transmitter assembly transmitting a first signal to a remote receiver when said processing assembly starts the vehicle, said transmitter assembly transmitting a second signal to the remote receiver when the vehicle has failed to start.

2. The programmable vehicle starting device as set forth in claim 1, further comprising:

a sound producing device being operationally coupled to said remote receiver, said sound producing device being positioned within a remote housing, said sound producing device producing a first unique sound adapted for indicating said processing assembly has started the vehicle, said sound producing device producing a second unique sound adapted for indicating said processing assembly has failed to start the vehicle.

3. The programmable vehicle starting device as set forth in claim 1, further comprising:

said buttons comprising a start time button, said time button actuating said processor assembly for switching between a first start time and a second start time such that said processing assembly displays the first start time and the second start time on said display screen.

4. The programmable vehicle starting device as set forth in claim 3, further comprising:

said buttons comprising a set button, said set button actuating said processing assembly for setting the first start time and the second start time for said processing assembly to start the vehicle when said set button is engaged by the user.

5. The programmable vehicle starting device as set forth in claim 4, further comprising:

said buttons comprising a plurality of time manipulation buttons, each of said time manipulation buttons actuating said processing assembly for adjusting the first start time and the second start time said processing assembly starts the vehicle when said time manipulation buttons are engaged by the user.

6. The programmable vehicle starting device as set forth in claim 3, further comprising:

said buttons comprising a meridiem selection button, said meridiem selection button actuating said processing assembly for adjusting the morning period and afternoon period of the first start time and the second start time.

7. The programmable vehicle starting device as set forth in claim 3, further comprising:

said buttons comprising an enter button, said enter button being adapted for indicating to said processor assembly the user has finished setting the first start time and the second start time.

8. The programmable vehicle starting device as set forth in claim 1, further comprising:

said buttons comprising a clock button, said clock button actuating said processor assembly for displaying a current time on said display screen.

9. The programmable vehicle starting device as set forth in claims 8, further comprising:

said buttons comprising a set button, said set button actuating said processing assembly for setting the current time for said processing assembly when said set button is engaged by the user.

10. The programmable vehicle starting device as set forth in claim 9, further comprising:

said buttons comprising a plurality of time manipulation buttons, each of said time manipulation buttons actuating said processing assembly for adjusting the current time displayed when said time manipulation buttons are engaged by the user.

11. The programmable vehicle starting device as set forth in claim 8, further comprising:

said buttons comprising a meridiem selection button, said meridiem selection button actuating said processing assembly for adjusting the morning period and afternoon period of the current time of said processing assembly.

12. The programmable vehicle starting device as set forth in claim 8, further comprising:

said buttons comprising an enter button, said enter button being adapted for indicating to said processor assembly the user has, finished setting the current time.

13. The programmable vehicle starting device as set forth in claim 1, further comprising:

said buttons comprising a main button, said main button being operationally coupled to said processing assembly, said main button being adapted for selectively disengaging said processing assembly from the ignition system of the vehicle when said main button is depressed by the user, said main button being adapted for selectively disconnecting said processing assembly from a power supply of the vehicle when said main button is held in depressed state for a length of time.

14. The programmable vehicle starting device as set forth in claim 2, further comprising:

said buttons comprising an alarm button, said alarm button being operationally coupled to said processing assembly such that said alarm button selectively disengages said processing assembly from said transmitter for preventing signals being transmitted to said remote receiver when said alarm button is depressed by the user.

15. A programmable vehicle starting device for programming the starting of a vehicle for a user when the user is not in the vehicle, the programmable vehicle starting device comprising:

a housing being adapted for being mounted in the vehicle;

a processing assembly being positioned within said housing, said processing assembly being adapted for operationally coupling to au ignition system of the vehicle such that said processing assembly starts an engine of the vehicle upon reaching a predetermined time;

a plurality of buttons being positioned on an upper face of said housing, each of said buttons being operationally coupled to said processing assembly such that said buttons are for manipulating the pre-determined time when said buttons are engaged by a finger of the user;

a display screen being positioned on said upper surface of said housing, said display screen being operationally coupled to said processing assembly such that said display screen is for displaying the pre-determined time;

a transmitter assembly being operationally coupled to said processing assembly, said transmitter assembly transmitting a first signal to a remote receiver when said processing assembly starts the vehicle, said transmitter assembly transmitting a second signal to the remote receiver when the vehicle has failed to start;

a sound producing device being operationally coupled to said remote receiver, said sound producing device being positioned within a remote housing, said sound producing device producing a first unique sound adapted for indicating said processing assembly has started the vehicle, said sound producing device producing a second unique sound adapted for indicating said processing assembly has failed to start the vehicle;

said buttons comprising a start time button, said time button actuating said processor assembly for switching between a first start time and a second start time such that said processing assembly displays the first start time and the second start time on said display screen;

said buttons comprising a clock button, said clock button actuating said processor assembly for displaying a current time on said display screen;

said buttons comprising a set button, said set button actuating said processing assembly for setting the first start time and the second start time for said processing assembly to start the vehicle when said set button is engaged after said start time button has been depressed by the user, said set button actuating said processing assembly for setting the current time for said processing assembly when said set button is engaged after said clock button has been depressed;

said buttons comprising a plurality of time manipulation buttons, each of said time manipulation buttons actuating said processing assembly for adjusting the first start time and the second start time said processing assembly starts the vehicle when said time manipulation buttons are engaged by the user, each of said time manipulation buttons actuating said processing assembly for adjusting the current time displayed when said time manipulation buttons are engaged by the user;

said buttons comprising a meridiem selection button, said meridiem selection button actuating said processing assembly for adjusting the morning period and afternoon period of the first start time and the second start time, said meridiem selection button actuating said processing assembly for adjusting the morning period and afternoon period of the current time of said processing assembly;

said buttons comprising an enter button, said enter button being adapted for indicating to said processor assembly the user has finished setting the first start time and the second start time, said enter button being adapted for indicating to said processor assembly the user has finished setting the current time;

said buttons comprising a main button, said main button being operationally coupled to said processing assembly, said main button being adapted for selectively disengaging said processing assembly from the ignition system of the vehicle when said main button is depressed by the user, said main button being adapted for selectively disconnecting said processing assembly from a power supply of the vehicle when said main button is held in depressed state for a length of time; and said buttons comprising an alarm button, said alarm button being operationally coupled to said processing assembly such that said alarm button selectively disengages said processing assembly from said transmitter for preventing signals being transmitted to said remote receiver when said alarm button is depressed by the user.

* * * * *